US005287155A

United States Patent [19]

Arai et al.

[11] Patent Number: 5,287,155

[45] Date of Patent: Feb. 15, 1994

[54] TEMPERATURE CONTROL METHOD FOR A FIXING DEVICE

[75] Inventors: Atsushi Arai, Ichikawa; Hirobumi Yoshino, Tokyo, both of Japan

[73] Assignee: Ricoh Company, Ltd., Tokyo, Japan

[21] Appl. No.: 810,859

[22] Filed: Dec. 20, 1991

[30] Foreign Application Priority Data

Dec. 21, 1990 [JP] Japan ..... 2-413165

[51] Int. Cl.[5] ..... G03G 15/20

[52] U.S. Cl. ..... 355/285; 219/216; 355/205

[58] Field of Search ..... 355/282, 285, 290, 208, 355/205, 207; 219/216, 469, 470, 471; 430/97-99, 124

[56] References Cited

U.S. PATENT DOCUMENTS

| | | | |
|---|---|---|---|
| 4,603,245 | 7/1986 | Yagasaki | 219/216 |
| 4,801,974 | 1/1989 | Suto et al. | 355/205 X |
| 4,868,368 | 9/1989 | Araki | 219/216 |
| 4,949,131 | 8/1990 | Ito | 355/282 |

FOREIGN PATENT DOCUMENTS 58-33278 2/1983 Japan .

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

A method of controlling the surface temperature of a heat roller included in a fixing device and having a heater therein by sensing it by a thermistor. The thermistor is held in contact with the heat roller during warm-up operation and in a standby condition or spaced apart from the heat roller while a copying operation is under way. The heater is on/off controlled on the basis of a temperature measured when the thermistor is spaced apart from the heat roller. The method corrects this temperature by comparing temperatures measured in the contact and non-contact positions of the thermistor. In such a correction mode, if the difference between the two measured temperatures does not lie in a predetermined range, the method stops energizing the heater determining that an error has occurred.

7 Claims, 12 Drawing Sheets

TEMPERATURE CONTROL METHOD FOR A FIXING DEVICE

BACKGROUND OF THE INVENTION

The present invention relates to a method of controlling the temperature of a fixing device incorporated in an electrophotographic copier, printer or similar image forming equipment.

A fixing device for the above application has a heat roller accommodating a heater therein, a press roller held in pressing contact with the heat roller, and a thermistor responsive to the surface temperature of the heat roller. The temperature of the heater is controlled on the basis of a signal representative of a temperature sensed by the thermistor. The thermistor may be held in contact with the surface of the heat roller, as taught in, for example, Japanese Patent Laid-Open Publication No. 49174/1987, or may be spaced apart from it, as disclosed in, for example, Japanese Patent Laid-Open Publication No. 88170/1986. The problem with the thermistor contacting the heat roller is that the former is apt to scratch or otherwise damage the latter due to friction. While this problem may be eliminated if the thermistor contacts part of the heat roller other than the part which a paper sheet passes, the thermistor in such a position cannot measure the temperature of the part which a paper sheet passes. This is critical considering the fact that the temperature of the part of the heat roller which a paper sheet passes drops on the passage of a paper sheet. On the other hand, when the thermistor is spaced apart from the heat roller, the roller is free from damage. With this configuration, however, it is necessary that the gap between the heat roller and the thermistor be supervised with extreme accuracy to accurately estimate the surface temperature of the roller from the sensed temperature. Moreover, since the output of the thermistor spaced apart from the heat roller is susceptible to the ambient temperature, the surface temperature to which the heat roller is controlled differs from the time just after the warm-up of the equipment to the time after a continuous operation.

SUMMARY OF THE INVENTION

It is, therefore, an object of the present invention to provide a temperature control method for a fixing device which frees a heat roller from damage and eliminates the need for accurate supervision over the gap between the roller and a thermistor.

In accordance with the present invention, a temperature control method for a fixing device incorporated in image forming equipment and having a heat roller which has a heater contained therein and a thermistor for sensing the surface temperature of the heat roller comprises the steps of moving the thermistor between a contact position contacting the surface of the heat roller and a non-contact position spaced apart from the surface of the heat roller, on/off controlling the heater of the heat roller in response to a temperature measured at the non-contact position, correcting the temperature measured at the non-contact position by comparing temperatures measured at the non-contact position and contact position, respectively, and stopping energizing the heater when a difference between the temperatures measured at the contact position and non-contact position does not lie in a predetermined range, determining that an error has occurred.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
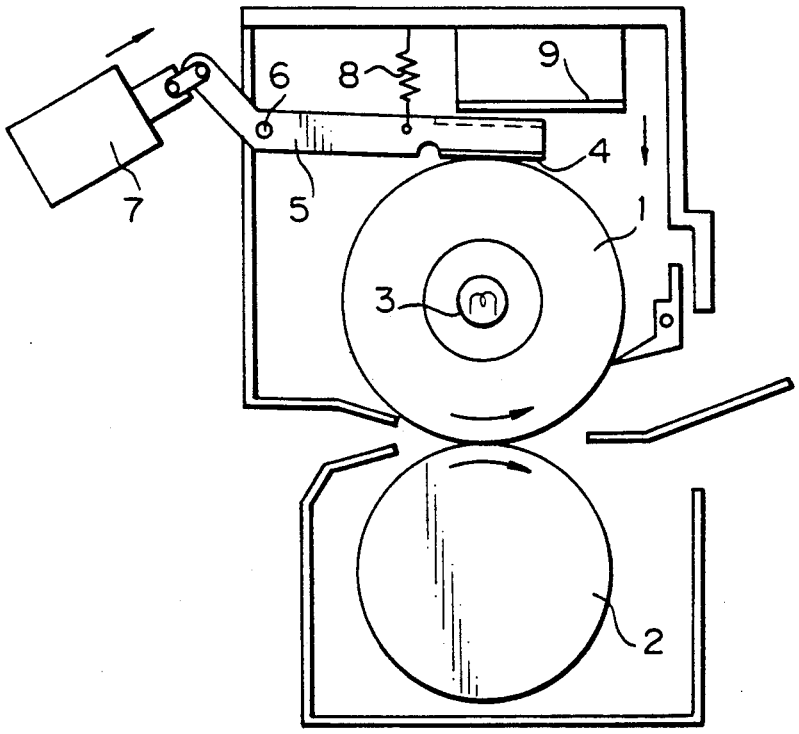
FIG. 1 is a front view showing a fixing device to which the present invention is applicable in a particular position.
Figure 2:
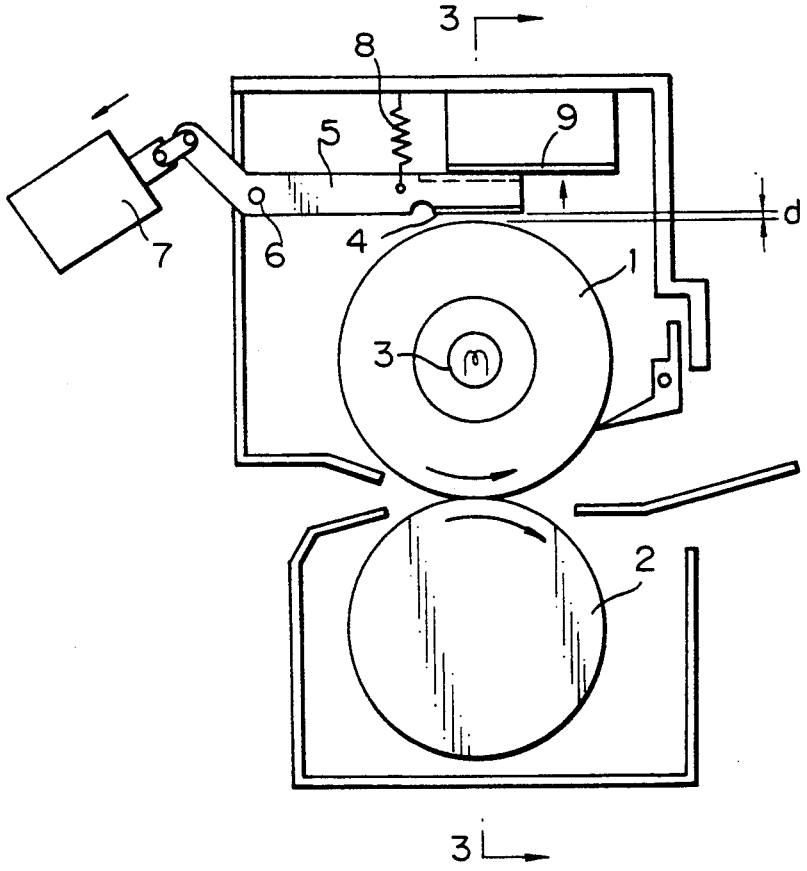
FIG. 2 is a view similar to FIG. 1, showing the fixing device in another particular position.
Figure 3:
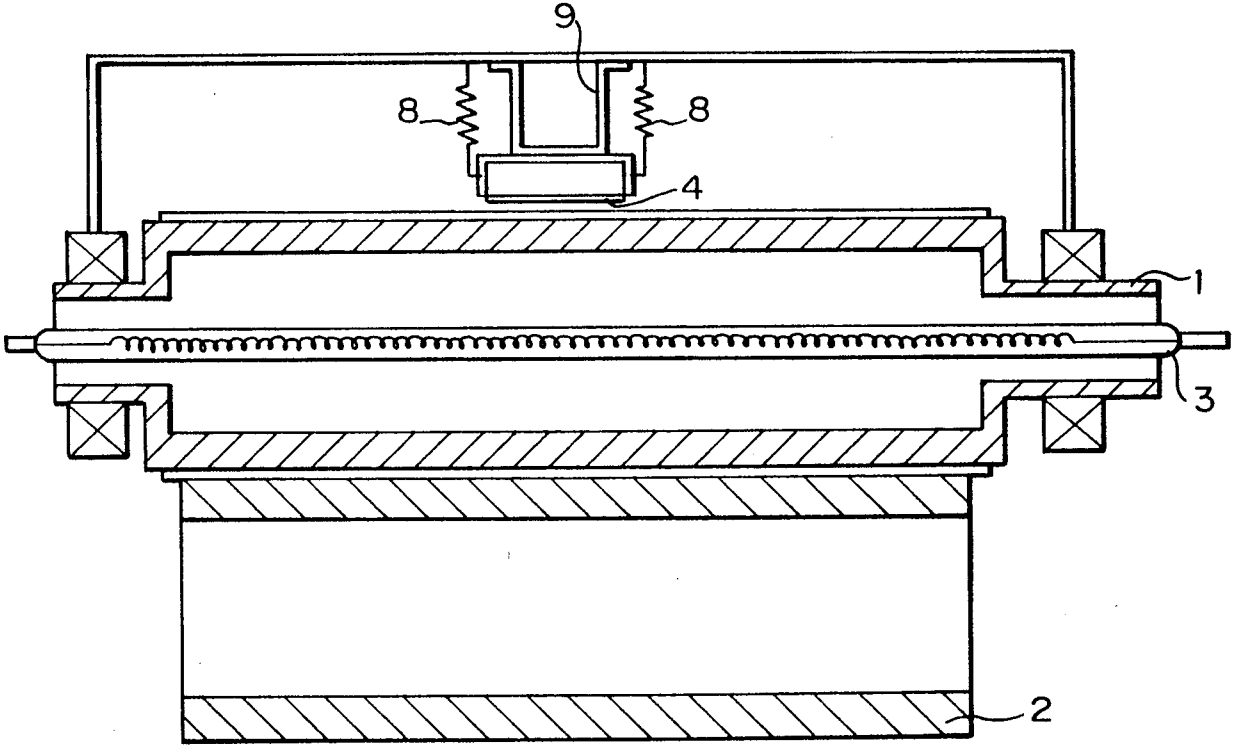
FIG. 3 is a section along line 3—3 of FIG. 2.

Referring to FIGS. 1-3 of the drawings, a fixing device with which the present invention is practiced is shown and includes a heat roller 1 having a heater 3 contained therein. A press roller 2 is located to face the heat roller 1. The heat roller 1 and the press roller 2 are each rotated in a direction indicated by an arrow in the figures. A thermistor 4 is disposed above the heat roller 1 and mounted on one end of a lever 5 which is journalled to a framework by a shaft 6. A solenoid 7 is mounted on image forming equipment and has the plunger thereof connected to the other end of the lever 5. A spring 8 constantly biases the lever 5 downward at the intermediate between the shaft 6 and the thermistor 4. When the solenoid 7 is energized, the thermistor 4 is spaced apart from the heat roller 1 by a gap d against the action of the spring 8, as shown in FIG. 2. When the solenoid 7 is deenerzied, the thermistor 4 is held in contact with the heat roller 1 by the spring 8, as shown in FIG. 1. In the position shown in FIG. 2, the lever 5 abuts against a stop 9 to maintain the gap d constant.

Figure 4:
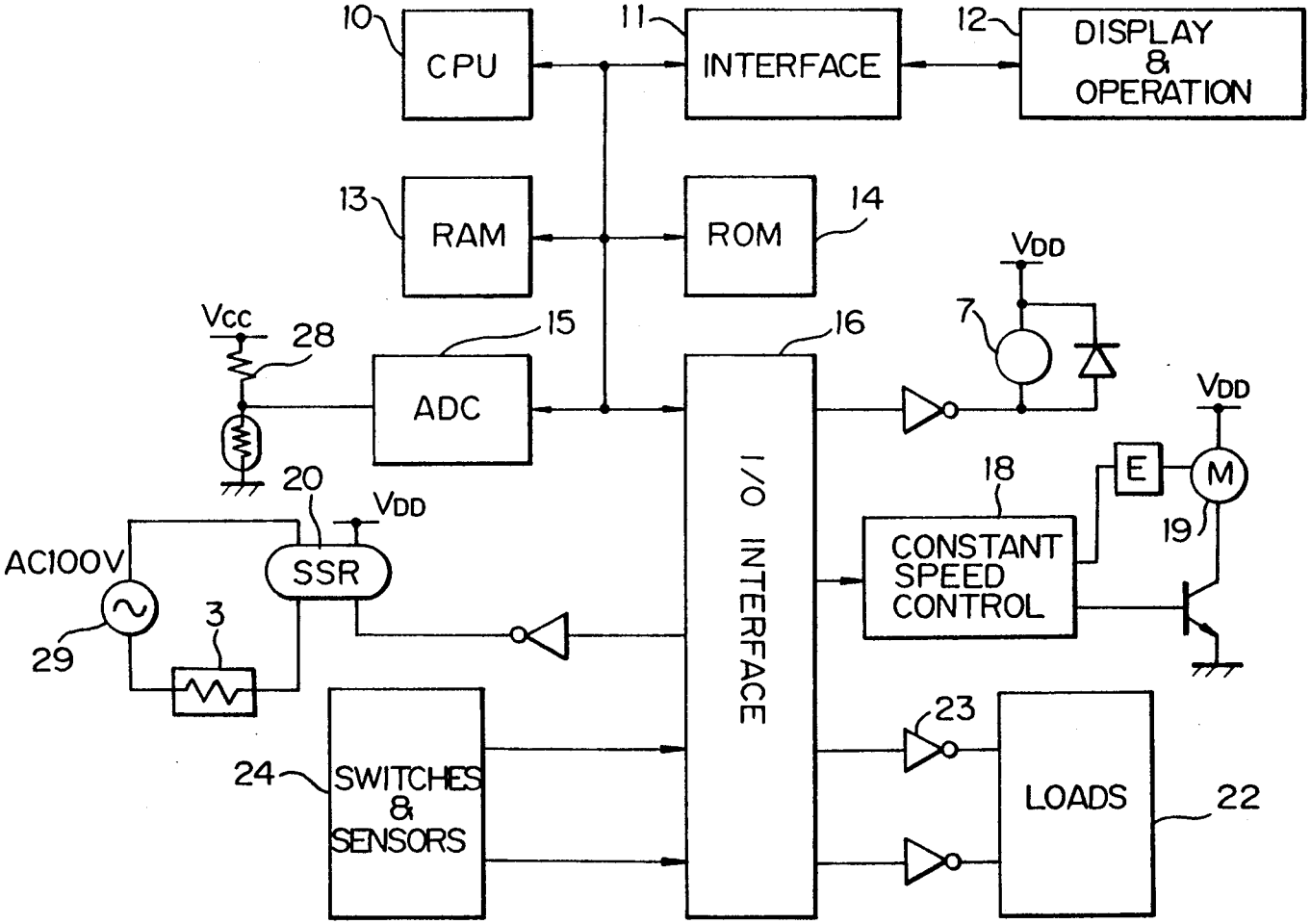
FIG. 4 is block diagram schematically showing a control system associated with the device of FIGS. 1-3.

FIG. 4 shows a control system associated with the fixing device having the above construction. The control system includes a microprocessor (CPU) 10 which executes control programs stored in a ROM 14. A display and operation board 12 is connected to the CPU 10 via an interface 11. A RAM 13 is accessible for reading and writing copy mode data and various flags. An analog-to-digital converter (ADC) 15 interfaces the thermistor 4 to the CPU 10 by converting an analog voltage outputted by the thermistor 4 to digital data. An input/output (I/O) interface 16 interfaces various loads and sensors arranged in the equipment one-to-one to the CPU 10. Connected to the I/O interface 16 are the solenoid 7, FIGS. 1 and 2, a main motor 19, a constant speed control circuit 18 associated with the motor 19, the heater 3, FIGS. 1-3, switches and sensors 24 included in other units, loads 22, and drivers 23. In the illustrative embodiment, the constant speed control circuit 18 is triggered by an on/off signal from the I/O interface 16 and uses the combination of an F/V control system and a PLL control system. The heater 3 is connected to a commercially available power source 29 and a drive SSR 20. The reference numeral 28 designates a voltage dividing register.

The thermistor 4 is implemented by a thin film having a small thermal time constant $\tau$ since it is expected to sense temperature around the heat roller 1 without contacting the roller 1 while the roller 1, i.e., the main motor 19 is in rotation. While the thermal time constant $\tau$ is selected to be about 2.5 seconds as measured in air in the embodiment, it is, of course, open to choice. The thermistor 4 has a negative temperature-to-resistance characteristic, i.e., NTC, and has the resistor 28 for delivering an analog voltage to the ADC 15. In the embodiment, the ADC 15 converts the input analog voltage to 8-bit data. On receiving the 8-bit data, the CPU 10 determines a temperature ts by referencing data stored in the ROM 14.

The heater 3 is driven by the turn-on and turn-off of the SSR 20 to maintain the surface temperature tr of the heat roller 1 at a control temperature tc (185° C. in the embodiment). The surface temperature tr of the heat roller 1 and the temperature ts sensed by the thermistor 4 are assumed to have the following relation:

in a contact position of thermistor (warm-up and standby)

$$tr = ts + to \qquad \text{Eq.(1)}$$

in a non-contact position of thermistor (main motor rotated as during copying)

$$tr = ts + to + \Delta t \qquad \text{Eq.(2)}$$

where to is a difference between the actual temperature tr of the roller 1 and the temperature ts sensed by the thermistor 4 while the thermistor 4 is in contact with the roller 1, and $\Delta t$ is a correcting term which is the essential feature of the present invention. The difference to varies depends on the structure of the thermistor 4, location and other factors and can be determined by experiments. The correcting term, i.e., temperature $\Delta t$ is determined in terms of, for example, a difference between the temperature ts which the thermistor 4 senses in contact with the heat roller 1 and the temperature ts which it senses out of contact with the roller 1. How the temperature $\Delta t$ is measured will be described later specifically.

While the thermistor 4 remains in contact with the heat roller 1 as during warm-up or in a standby condition, the temperature tr represented by the Eq. (1) is compared with the control temperature tc. While the thermistor 4 is spaced apart from the heat roller 1 due to the rotation of the main motor as during copying, the temperature tr represented by the Eq. (2) is compared with the control temperature tc. In any case, if the temperature tr is lower than the control temperature tc, the heat roller 1 is turned on; if the former is higher than the latter, the heat roller 1 is turned off. As a result, the surface temperature of the heat roller 1 is controlled to the temperature tc.

The movement of the thermistor 4 into and out of contact with the heat roller 1 is caused by the solenoid 7 according to the above-stated mode. In such a configuration, a response time of the thermistor 4 exists with respect to the temperatures. Specifically, when the thermistor 4 is moved away from the roller 1, the response time is several times greater than the thermal time constant $\tau$, e.g., 7.5–10 seconds; when the former is brought into contact with the latter, the response time is less than 1 second. During the response time, the embodiment does not control the heater 3 (heater off).

Figure 5:
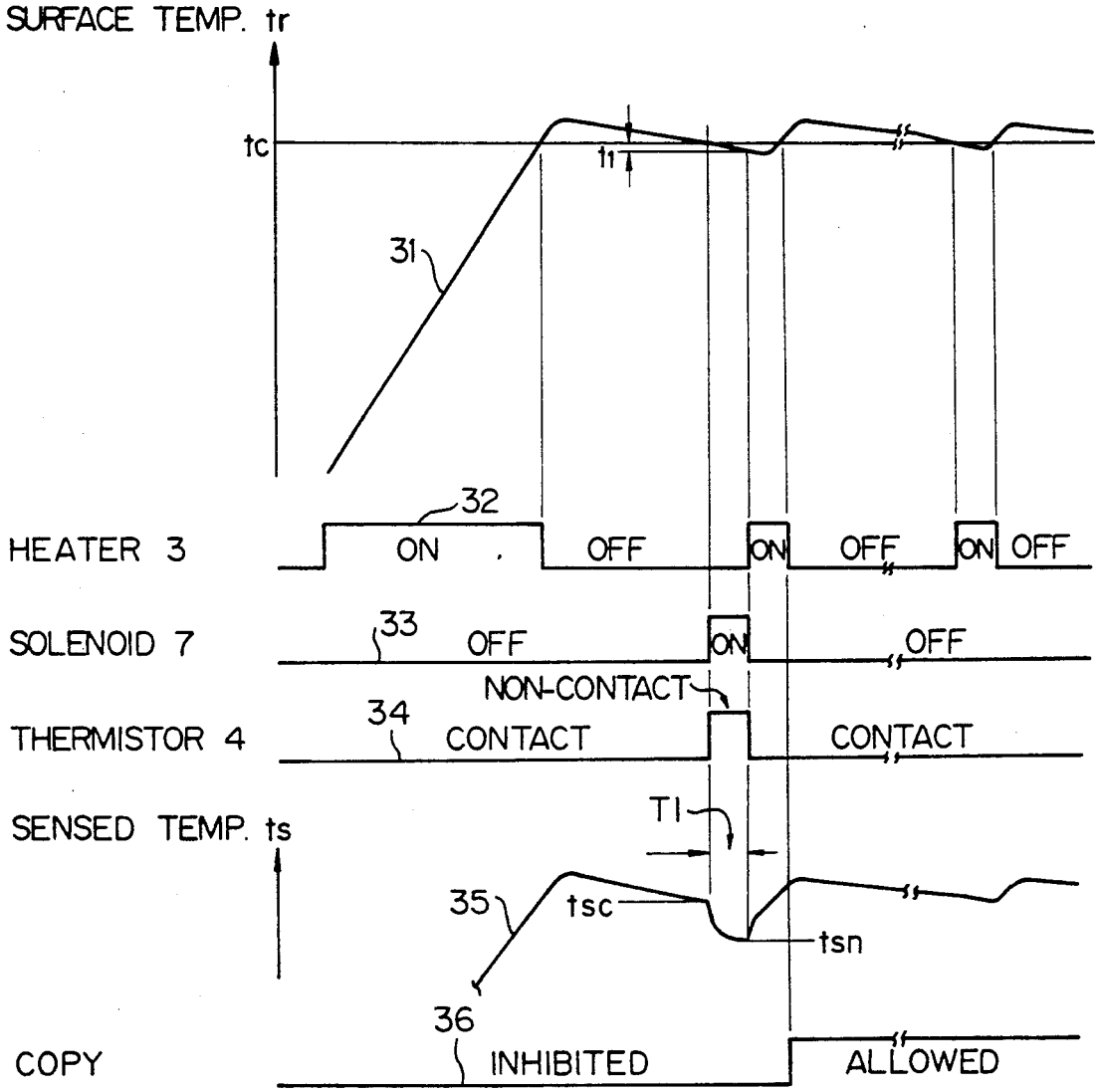
FIG. 5 shows a measurement sequence in a correction mode which occurs after a warm-up operation.

Specifically, FIG. 5 shows a sequence for executing a mode for measuring the correcting term $\Delta t$ during warm-up operation after the turn-on of the main switch or during warm-up operation after the removal of a jamming sheet or after opening of a door. In FIG. 5, the reference numerals 31, 32, 33, 34, 35 and 36 indicate respectively the surface temperature tr of the heat roller 1, the on/off state of the heater 3, the on/off state of the solenoid 7, the contact/non-contact state of the thermistor 4 with the heat roller 1, the temperature ts sensed by the thermistor 4, and the ready/busy state of the equipment, i.e., whether or not a warm-up operation is under way. While a warm-up operation is under way, the thermistor 4 remains in contact with the heat roller 1 and has the heater 3 thereof controlled by the Eq. (1). On the elevation of the temperature tr to the temperature tc, the heater 3 is turned off with the result that the temperature tr sequentially drops after overshoot. As soon as the temperature tr again coincides with the temperature tc, the measurement of the correcting term $\Delta t$ begins. The temperature ts at this moment is delivered as temperature data tsc. Subsequently, the solenoid 7 is energized to move the thermistor 4 a predetermined distance away from the heat roller 1. At this instant, the heater 3 is forcibly turned off. On the elapse of a period of time T1 several times longer than the thermal time constant $\tau$ (nearly equal to $4\tau$), the instantaneous temperature ts is delivered as temperature data tsn. Then, the solenoid 7 is deenergized to bring the thermistor 4 into contact with the heater roller 1. The control over the heater 3 is resumed on the elapse of a temperature response time. When the temperature tr again coincides with the temperature tc and the heater 3 is turned off, the control system sets up a ready state considering that the warm-up operation has completed.

In the above condition, the correcting term $\Delta t$ is produced by:

$$\Delta t = tsc - tsn - t_1 \qquad \text{Eq.(3)}$$

where $t_1$ indicates a drop of the surface temperature tr of the heat roller 1 ascribable to the turn-off state of the heater 3 continuing over a period of time T1 in which the thermistor 4 having been spaced apart from the roller 1 responds to the ambient temperature. Stated another way, the temperature tr at the time when the temperature tsn is measured is assumed to be a temperature $tsc - t_1$; the temperature $t_1$ is also determined by experiments. Up to the time when the correcting term $\Delta t$ should be measured again (usually, after a copying operation), the correcting term $\Delta t$ determined as stated above is stored in the RAM 13 as valid data. When a copying operation begins with the thermistor 4 spaced apart from the heat roller 1, the heater 3 is controlled by the Eq. (2). When the resulting correcting term $\Delta t$ is greater than a predetermined value or smaller than a predetermined value, the control system determines that it is unusual, as will be described in detail later.

Figure 6:
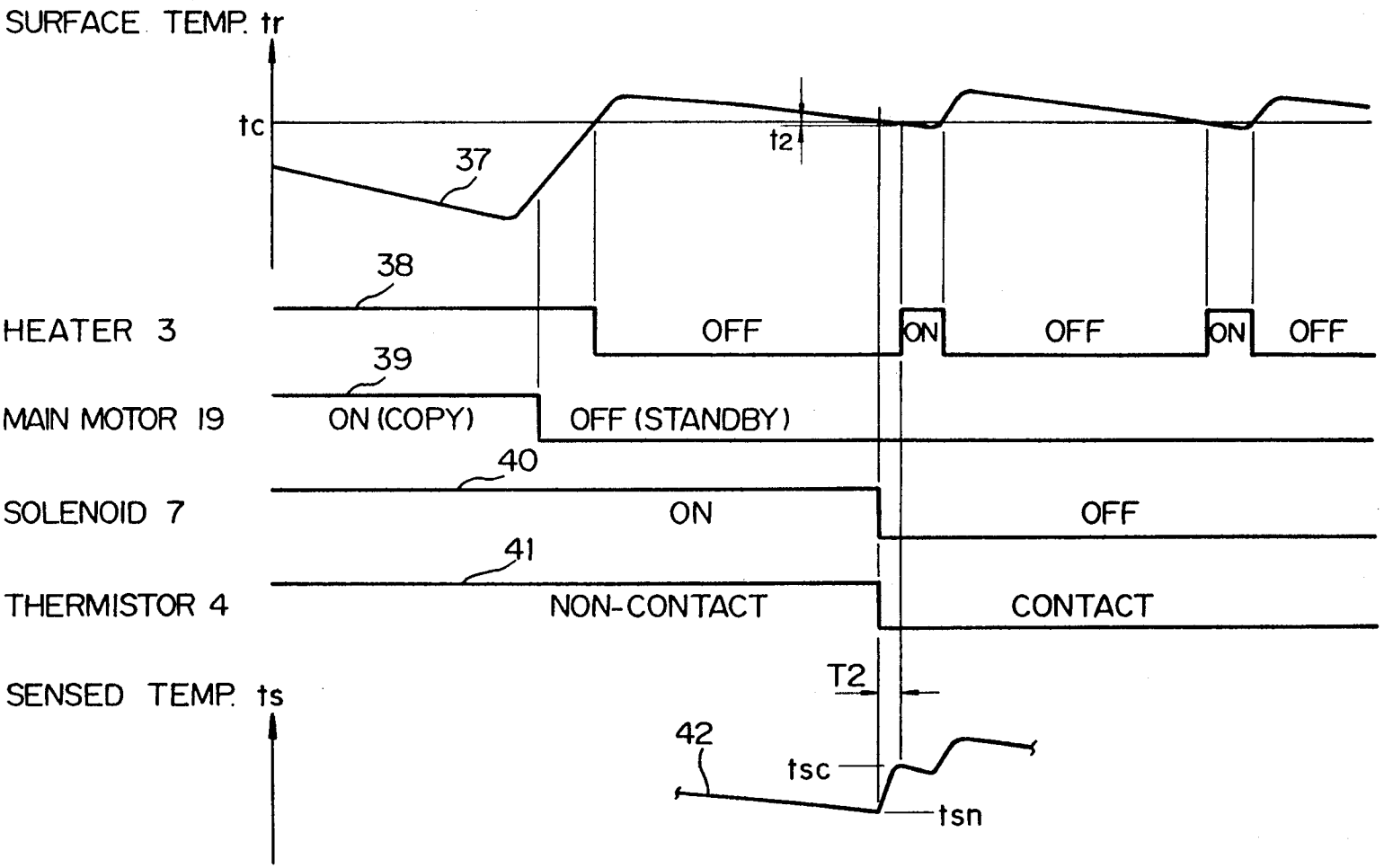
FIG. 6 shows a measurement sequence in a correction mode which occurs after a copying operation.

FIG. 6 demonstrates a mode for measuring the correcting term $\Delta t$ after a copying operation. In the figure, the reference numerals 37, 38, 39, 40, 41 and 42 indicate respectively the surface temperature tr of the heat roller 1, the on/off state of the heater 3, the on/off state (copy/standby state) of the main motor 19, the on/off state of the solenoid 7, the contact/non-contact state of the thermistor 4 with the heat roller 1, and the variation of the temperature tsc sensed by the thermistor 4. While a copying operation is under way, the heater 3 is controlled with the temperature tr determined by the last correcting term Δt. In the illustrative embodiment, since the power necessary for fixation is greater than the power of the heater 3, the temperature tr tends to drop even when the heater 3 is continuously turned on. After a desired number of copies have been produced, the solenoid 7 is not energized although the main motor 19 is turned off, so that the Δt measure mode may be effected. Specifically, on the elevation of the surface temperature tr of the heat roller 1 to the control temperature tc, the heater 3 is turned off. As soon as the temperature tr again coincides with the temperature tc, the measurement of the correcting term Δt begins. At this time, the instantaneous temperature ts is delivered as temperature data tsn. Thereafter, the solenoid 7 is turned off to allow the thermistor 4 to contact the heat roller 1. At this instant, the heater 3 is forcibly turned off. As a response time T2 (nearly equal to 1 second) due to the contact of the thermistor 4 with the heat roller 1 expires, the temperature ts is measured as a temperature tsc while the heater 3 is turned on again. The resulting temperature data tsc and tsn are used to determine a new correcting term Δt, as follows:

$$\Delta t = tsc - tsn - t_2 \qquad \text{Eq. (4)}$$

where the temperature $t_2$ is a drop of the temperature tr which occurs during the response time T2, as in the Eq. (3), and determined by experiments.

Figure 9:
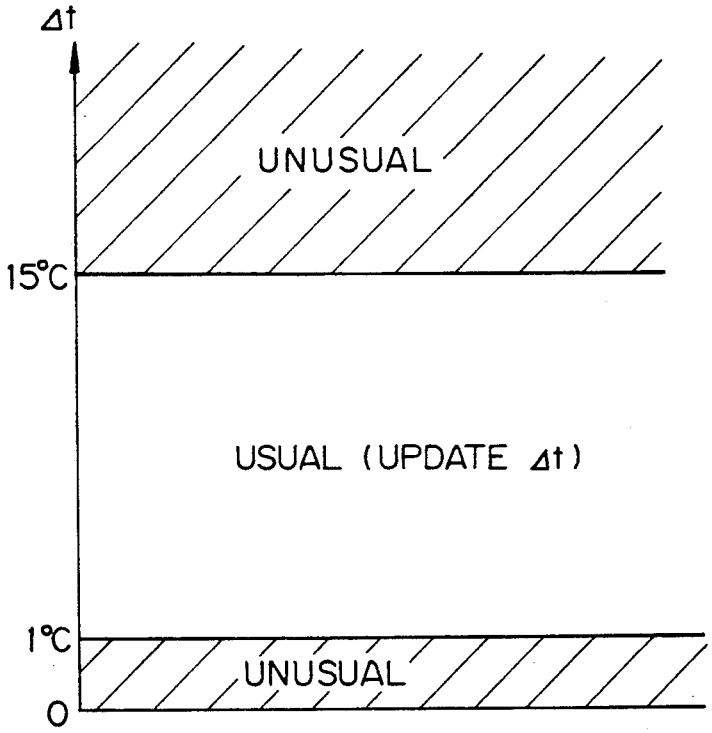
FIG. 9 shows a specific range in which a correcting term should be confined.

As shown in FIG. 9, assume that the newly determined correcting term Δt is higher than a predetermined value (15° C. in the embodiment) or lower than a predetermined value (1° C. in the embodiment). Then, the control system determines that the thermistor 4 is in an error state, sets an error flag, and displays the stop of operation and the error on the display and operation board 12. If the correcting term Δt lies in the above-mentioned range, it is compared with the previous correcting term Δt and, if not different from the latter by more than a predetermined value (1° C. in the embodiment), is not updated. Specifically, the control system determines that the interior of the fixing device has reached thermal equilibrium and does not execute any further Δt measurement. If the new correcting term Δt differs from the previous one by more than the predetermined value, the control system updates it by a correcting term Δt which it will measure later. Whether or not the correcting term Δt is unusual is also determined during measurement which follows the warm-up operation. If desired, the correcting term Δt may be measured each time and not be updated so long as it does not differ from the previous Δt measurement by more than a predetermined value.

Figure 8:
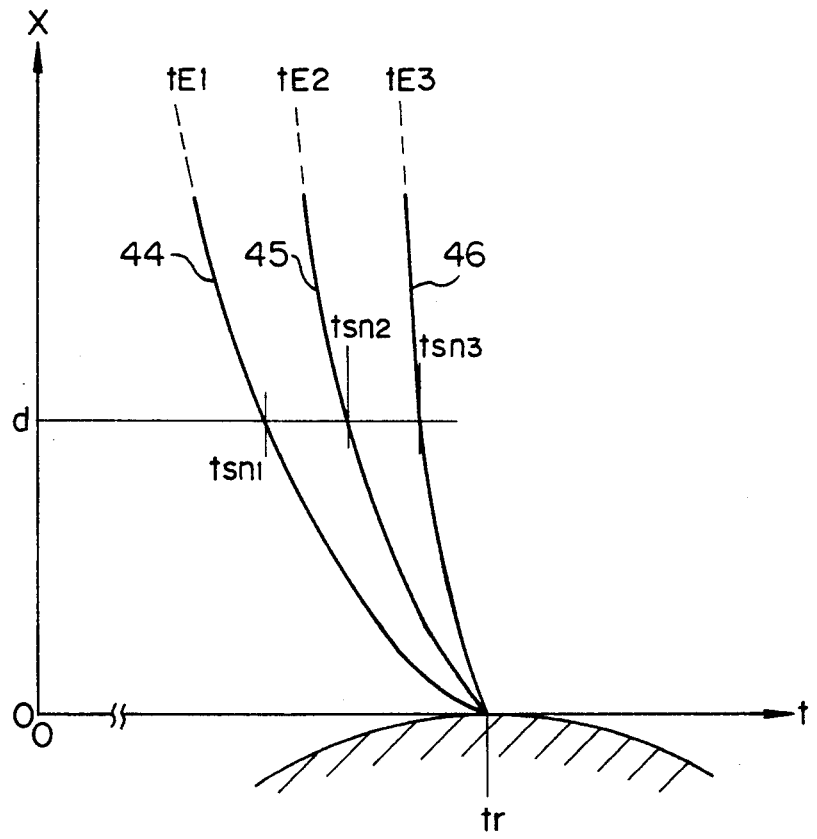
FIG. 8 is a graph showing temperature distributions in the vicinity of a heat roller.

Updating the correcting member Δt by the repetitive measurement matches the characteristic shown in FIG. 8. As shown, when the temperature tEl inside the fixing device is low as during warm-up operation, the temperature around the thermistor 4 spaced apart from the heat roller 1 by the gap d is $tsn_1$ which is far lower than the surface temperature tr of the roller 1, as indicated by a curve 44. As the ambient temperature increases due to the repetitive copying operation, the temperature tsn also approaches the saturation level $tsn_3$. Measuring the correcting term Δt thereafter is meaningless, i.e., the control based on the temperature $tsn_3$ suffices so long as the equipment is free from disturbances such as the removal of a jamming sheet and the opening of the door.

Figure 7:
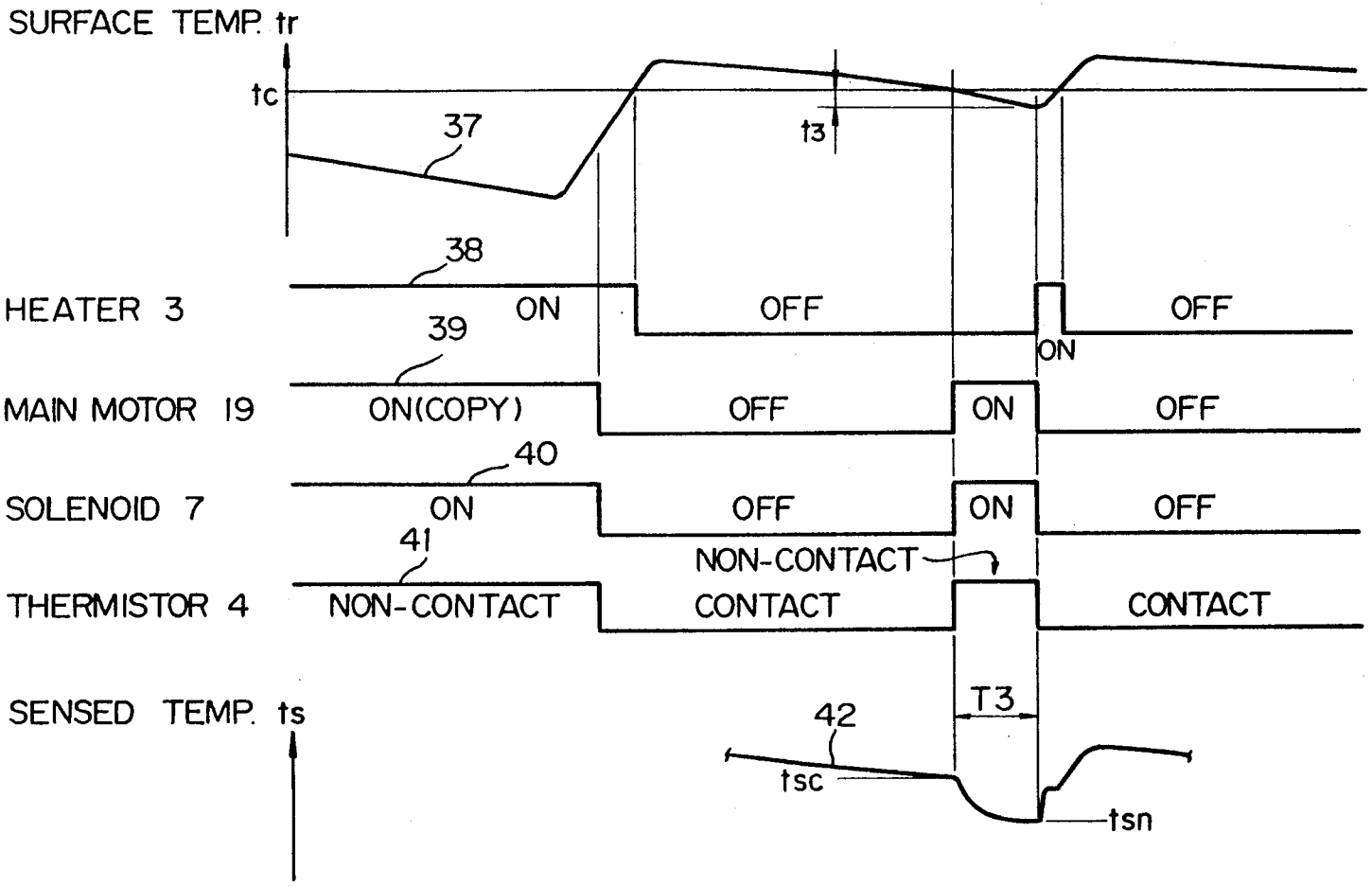
FIG. 7 shows a sequence for executing a correction mode after a copying operation and while a heat roller is in rotation.

FIG. 7 shows a sequence similar to the sequence of FIG. 6 except that the main motor 19, i.e., the heat roller 1 is rotated for the measurement of the temperature tsn. The temperature distribution around the heat roller 1 shown in FIG. 8 is expected to differ from the condition wherein the roller 1 is rotated to the condition wherein the roller 1 is held in a halt. Since it is when the main motor 19 is rotated (basically, in a copy mode) that the heater 3 has to be controlled with the thermistor 4 spaced apart from the roller 1, it may be considered that the temperature tsn in such a condition gives a correcting term Δt closest to actual one. However, such a consideration is not directly applicable to the Δt measure mode to be effected after the warm-up. Specifically, since the temperature of the press roller 2 coactive with the heat roller 1 has elevated little just after the warm-up, the surface temperature of the roller 1 is sharply lowered due to the rotation to make it difficult to estimate the temperature $t_1$. For this reason, when the Δt measure mode is to be effected while the heat roller 1 is in rotation, it is necessary that the rollers 1 and 2 have been sufficiently idled to elevate the surface temperature of the pressure roller 2 also. However, the problem is which correcting item Δt should be selected for the control over the heater 3 during idling. Presumably, the only implementation is to use a fixed correcting item Δt or to continue idling over a predetermined period of time while maintaining the heater 3 turned on. After the copying operation, the press roller 2 is expected to have been heated by the heat roller 1, eliminating the above-stated problem.

In FIG. 7, as a desired number of copies are produced, the main motor 19 and solenoid 7 are turned off with the result that the thermistor 4 is brought into contact with the heat roller 1. After the surface temperature tr has coincided with the control temperature tc, the heater 3 is turned off. As soon as the surface temperature tr again coincides with the control temperature tc, the measurement of a correcting item Δt begins. In this case, the temperature ts is measured with the thermistor 4 contacting the heat roller 1, whereby a temperature tsc is determined. Subsequently, the main motor 19 and solenoid 7 are turned on, and the heater 3 is forcibly turned off. On the elapse of the response time T3 of the thermistor 4, the temperature ts is measured and delivered as temperature data tsn. Then, the main motor 19 and solenoid 7 are turned off. In this case, the correcting item Δt is produced by:

$$\Delta t = tsc - tsn - t_3 \qquad \text{Eq. (5)}$$

where $t_3$ is a drop of the temperature tr occurred during the response time T3, as in the Eq. (3), and is determined by experiments. The resulting correcting item Δt is processed in the same manner as in FIG. 6, and the processing will not be described to avoid redundancy. while in the sequence of FIG. 7 the main motor 19 is turned off and the thermistor 4 is brought into contact with the heat roller 1 after the copying operation, they may be continuously turned on up to the time for measuring the temperature tsc so as to measure the temperature tsn and, thereafter, turned off to measure the temperature tsc.

Figure 10:
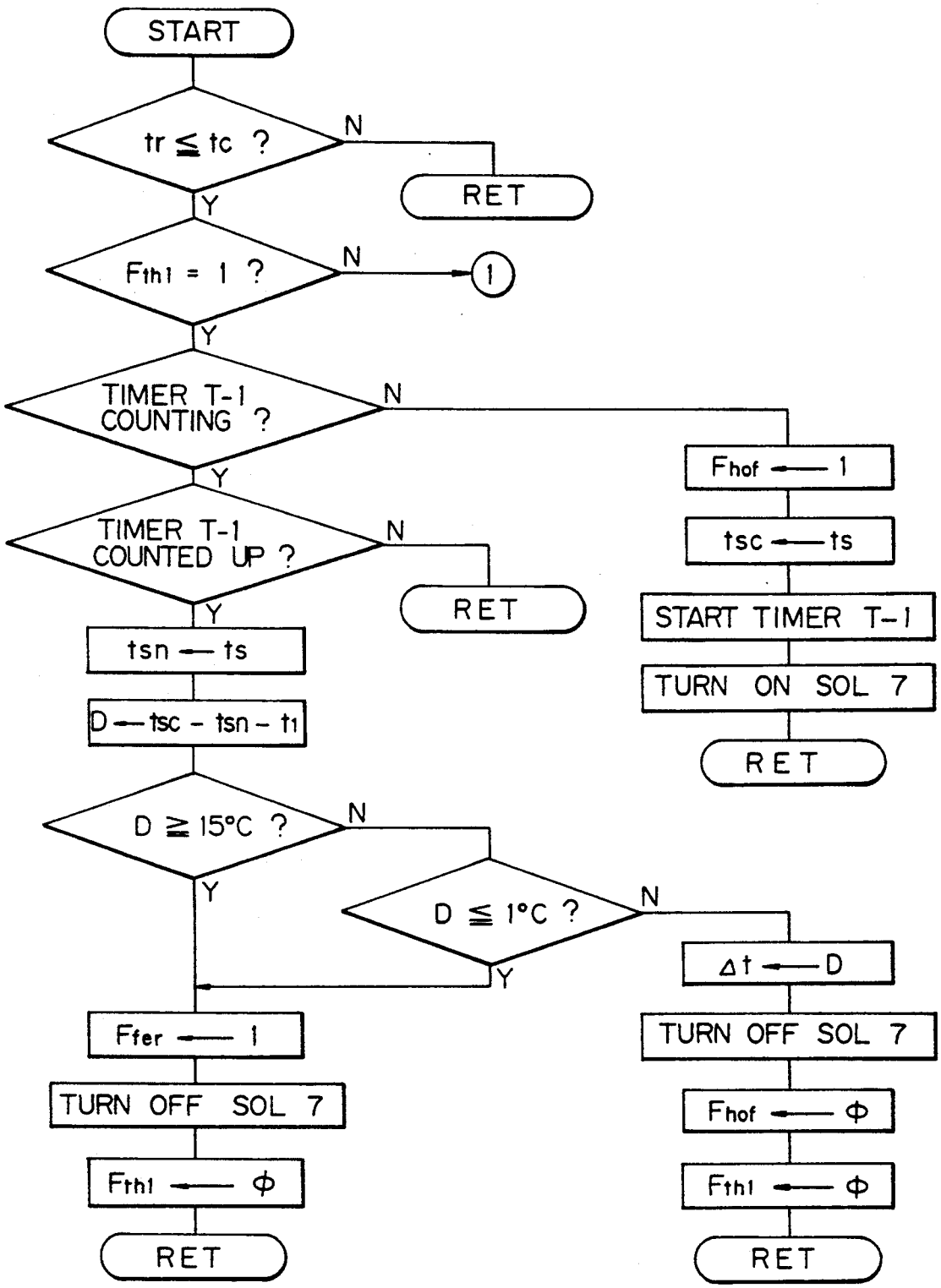
FIGS. 10-12 are flowcharts associated with the measurement sequences shown in FIGS. 5-7, respectively.
Figure 11:
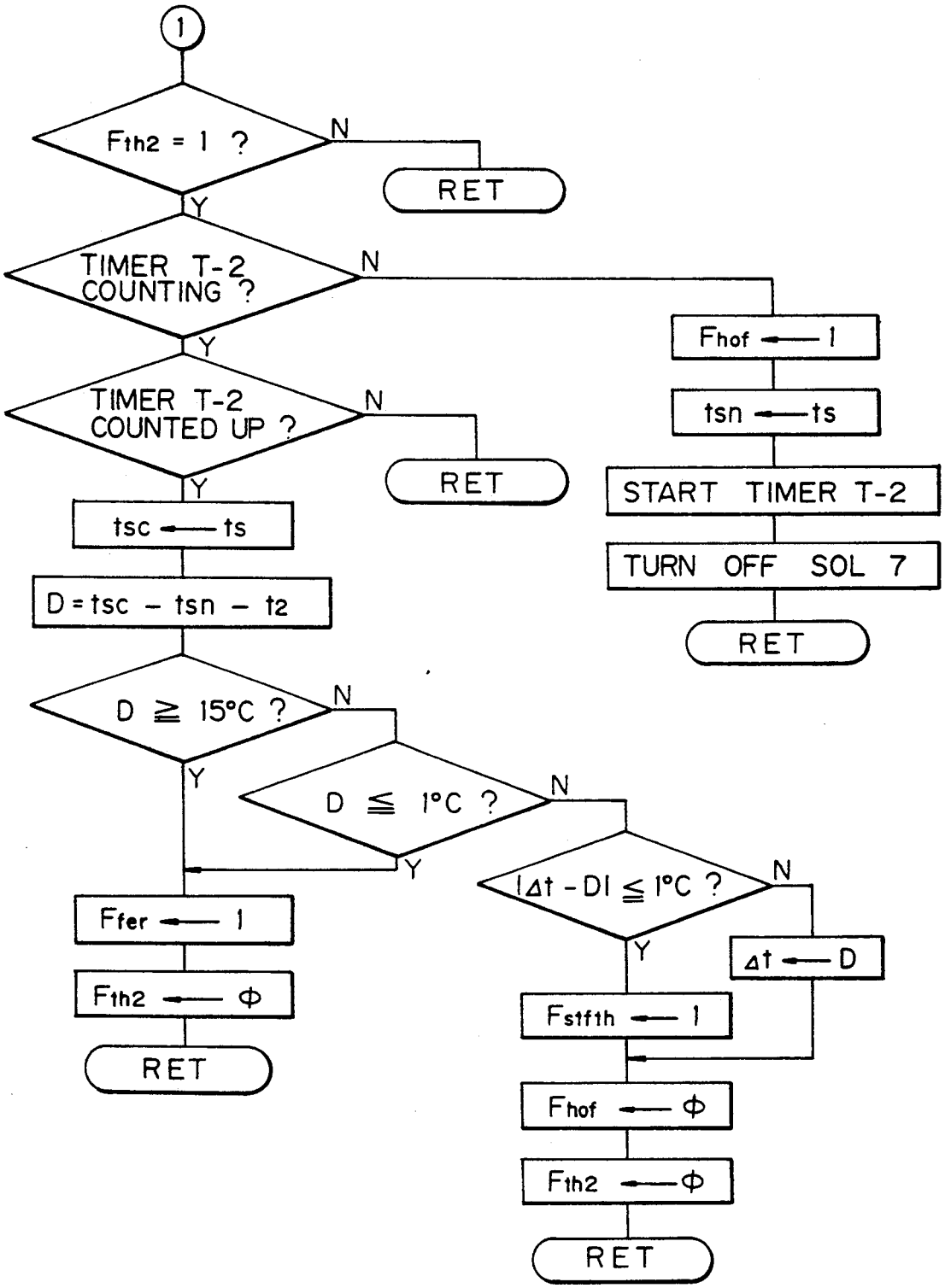
Figure 12:
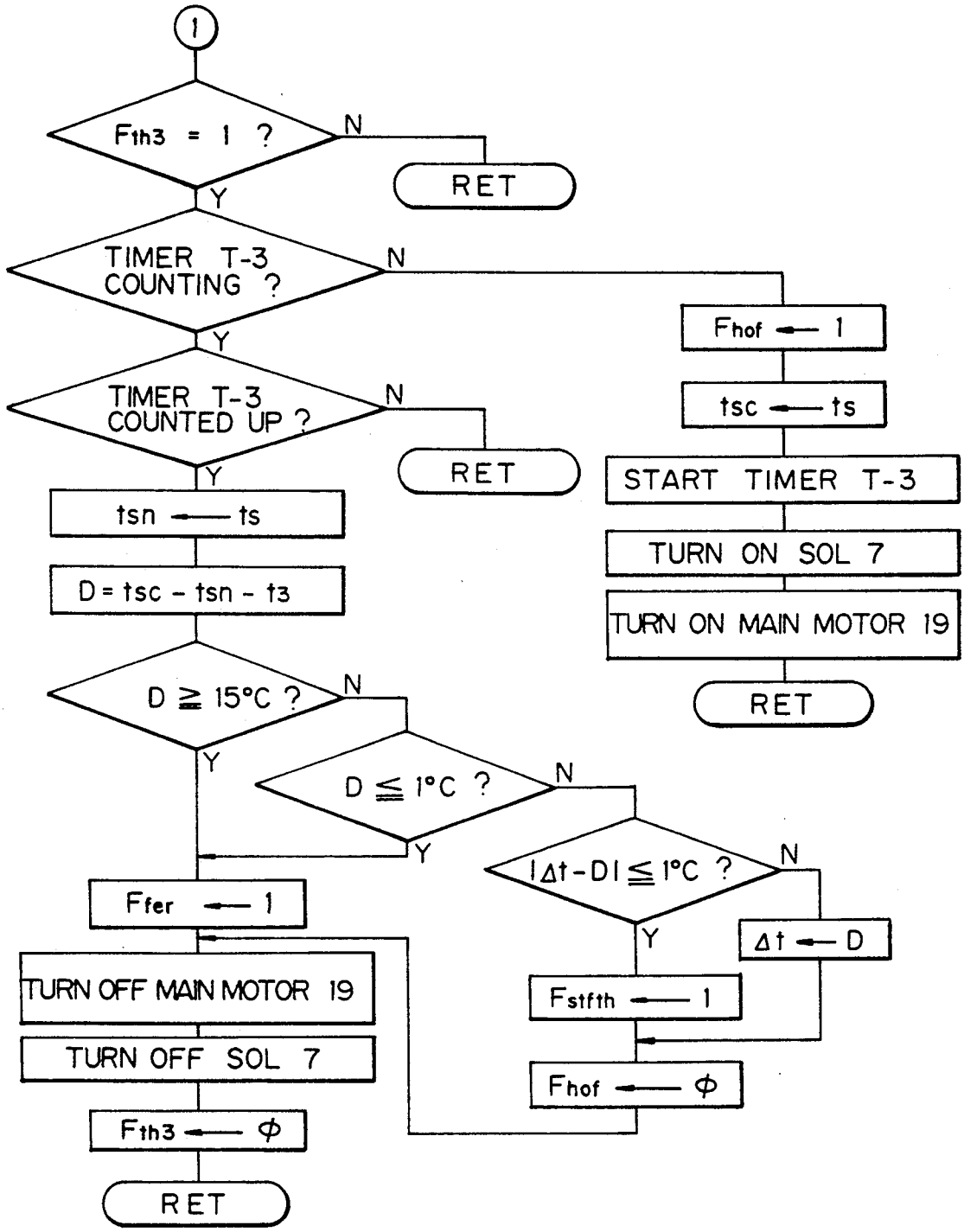

FIGS. 10–12 are flowcharts each showing a particular Δt measure sequence. FIGS. 10, 11 and 12 correspond to FIGS. 5, 6 and 7, respectively. Regarding a subroutine, FIGS. 10 and 11 or FIGS. 10 and 12 are combined. The flowcharts include Δt measure flags $Fth_1$, $Fth_2$ and $Fth_3$ which are selectively set in a main routine, not shown. The flag $Fth_1$ is set at a heater-off timing during warm-up operation while the flags $Fth_2$ and $Fth_3$ are each set at the first heater-off timing after a copying operation.

In FIG. 10, whether or not the temperature tr has dropped below the temperature tc is determined. If the temperature tr is lower than the temperature tc, whether or not the measurement of the correcting item Δt to be effected follows a warm-up operation, i.e., whether or not the flag $Fth_1$ has been set is determined. If the flag $Fth_1$ has been set, whether or not a timer T-1 is counting is determined. If the counter T-1 is not counting, meaning that this routine can be executed, a forcible heater-off flag Fhof is set and the temperature ts is read to produce temperature data tsc. Then, the timer T-1 is started, and the solenoid 7 is turned on. On the other hand, if the timer T-1 is counting, whether or not it has counted up is determined; if the answer is negative, the program returns. If the timer T-1 has counted up, the temperature ts is read to produce temperature data tsn, and the operation $tsc-tsn-t_1$ is performed to produce a value D. Whether or not the value D is usual is determined on the basis of relations $D>15°$ C. and $D<1°$ C. If the value D is unusual, a fixation error flag Ffer is set, the solenoid 7 is deenergized, the flag $Fth_1$ is reset, and then the program returns. If the value is usual, it is stored as Δt, the solenoid 7 is deenergized, and the flags Fhor and $Fth_1$ are reset.

When the result of decision on the flag $Fth_1$ shown in FIG. 10 is negative, the operation is transferred to the flow shown in FIG. 11. First, whether or not the flag $Fth_2$ has been set is determined. If the flag $Fth_2$ has been set, whether or not a timer T-2 is counting is determined. If the result of this decision is negative, the forcible heater-off flag Fhof is set to read the temperature ts. This temperature is stored as temperature data tsn, and then the timer T-2 is started. Subsequently, the solenoid 7 is turned off, and the program returns. On the other hand, if the timer T-2 is counting, whether or not it has counted up is determined. If the counter T-2 has not counted up, the program returns; if it has counted up, the temperature ts is read and stored as temperature data tsc. Thereafter, the operation $tsc-tsn-t_2$ is performed to produce a value D. Whether or not this value D is usual is determined on the basis of relations $D\geqq 15°$ C. and $D\geqq 1°$ C. If the value D is unusual, the fixation error flag Ffer is set, the flag $Fth_2$ is reset, and then the program returns; if otherwise, a difference between the value D and the previous correcting item Δt is produced. If the absolute value of the difference is less than 1° C., the control system sets a flag Fstfth responsive to future Δt measurements, resets the flags Fhof and $Fth_2$, and returns, determining that thermal equilibrium has been reached. If $|\Delta t-D|$ is greater than 1° C., the control system substitutes the value Δ for the correcting item Δt, resets the flags Fhof and $Fth_2$, and returns, determining that thermal equilibrium has not been reached. Alternatively, on finding thermal equilibrium, the control system may not set the flag Fstfth or update the correcting item Δt. Then, Δt will be measured each time after a copying operation so as to update the data only when it changes.

FIG. 12 shows an alternative Δt measuring sequence which follows the flow of FIG. 10 and measures tsn by rotating the heat roller 1. As shown, whether or not the flag $Fth_3$ has been set is determined, and if it has been set whether or not a timer T-3 is counting is determined. If the answer of this step is negative, the forcible heater-off flag Fhof is set to read the temperature ts. This temperature is stored as data tsc. Subsequently, the timer T-3 is started, the solenoid 7 and main motor 19 are turned on, and the program returns. If the timer T-3 is counting, whether or not it has counted up is determined; if it has not counted up, the program returns. If the counter T-3 has counted up, the temperature ts is stored as data tsn, and then the operation $tsc-tsn-t_3$ is performed. Whether the resulting value D is usual is determined on the basis of the relations $D\geqq 15°$ C. and $D\leqq 1°$ C. If the value D is unusual, the fixation error flag Ffer is set, the main motor 19 and solenoid 7 are turned off, the flag $Fth_3$ is reset, and the program returns. If the value D is usual, a difference between the value D and the correcting item Δt is produced, and then whether or not the absolute value of the difference is less than 1° C. is determined. If the answer of this step is positive, the control system sets a flag Fstfth which prevents the flag $Fth_3$ from being set, resets the flag Fhof, turns off the main motor 19 and solenoid 7, resets the flag $Fth_3$, and returns, determining that thermal equilibrium has been set up. If $|\Delta t-D|$ is greater than 1° C., the control system updates Δt by the value D, determining that thermal equilibrium has not been set. Again, the program may be so modified as not to set the flag Fstfth on determining that thermal equilibrium has been set up.

In summary, it will be seen that the present invention provides a temperature control system for a fixing unit which eliminates unusual temperature elevation ascribable to an error which may occur in a mechanism for moving a thermistor into and out of contact with a heat roller, and protects the heat roller against damage which is likely to occur if the thermistor continuously contacts the heat roller.

Various modifications will become possible for those skilled in the art after receiving the teachings of the present disclosure without departing from the scope thereof.

What is claimed is:

1. A temperature control method for a fixing device incorporated in image forming equipment and having a heat roller which has a heater contained therein and a thermistor for sensing a surface temperature of said heat roller, said method comprising the steps of:

(a) moving said thermistor between a contact position contacting the surface of said heat roller, and a non-contact position spaced apart from said surface of said heat roller;

(b) on/off controlling said heater of said heat roller in response to a temperature measured at said non-contact position;

(c) correcting said temperature measured in step (b) by comparing temperatures measured at said non-contact position and said contact position, respectively; and (d) stopping energizing said heater when a difference between said temperatures measured at said contact position and said non-contact position in step (c) does not lie in a predetermined range, thereby indicating that an error has occurred.

2. A method as claimed in claim 1, wherein step (a) comprises (e) moving said thermistor to said contact position during warm-up operation and in a standby condition, and (f) moving said thermistor to said non-contact position during image forming operation.

3. A method as claimed in claim 1, wherein step (c) comprises the step of adding a variable temperature value to a temperature value sensed by said thermistor when said thermistor is in said non-contact position.

4. A method as claimed in claim 3, wherein step (c) further comprises the step of either adding or subtracting a predetermined fixed temperature value to said temperature value sensed by said thermistor when said thermistor is in said non-contact position.

5. A method as claimed in claim 2, further comprising the step of comparing said surface temperature of said heat roller with a control temperature.

6. A method as claimed in claim 1, wherein step (a) comprises moving said thermistor between said contact position and said non-contact position using a solenoid device.

7. A method as claimed in claim 5, wherein step (b) comprises the steps of raising said surface temperature of said heat roller to said control temperature, turning off said heater, and calculating a correcting temperature value.

* * * * *